US008596477B2

(12) United States Patent
Kras et al.

(10) Patent No.: US 8,596,477 B2
(45) Date of Patent: Dec. 3, 2013

(54) RETORTABLE PACKAGE WITH PLASTIC CLOSURE CAP

(75) Inventors: Stephen Kras, Chicago, IL (US); Dennis Szczesniak, Palos Hills, IL (US); James Taber, Aurora, IL (US); William Kapolas, Des Plaines, IL (US); Kevin Orth, Des Plaines, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 912 days.

(21) Appl. No.: 11/617,486

(22) Filed: Dec. 28, 2006

(65) Prior Publication Data

US 2007/0187352 A1 Aug. 16, 2007

Related U.S. Application Data

(60) Provisional application No. 60/754,477, filed on Dec. 28, 2005.

(51) Int. Cl.
*B65D 41/04* (2006.01)
*B65D 53/04* (2006.01)

(52) U.S. Cl.
USPC ..... 215/276; 215/349

(58) Field of Classification Search
USPC ..... 215/261, 276, 349, 350, 351
See application file for complete search history.

(56) References Cited

U.S. PATENT DOCUMENTS

| | | | | |
|---|---|---|---|---|
| 1,972,280 | A | 9/1934 | Von Till | |
| 2,047,720 | A | 7/1936 | Wilhelm | |
| 2,080,686 | A * | 5/1937 | Bennett | 215/303 |
| 2,151,019 | A | 3/1939 | Eisen | |
| 2,270,729 | A * | 1/1942 | Geddes | 215/276 |
| 3,209,934 | A | 10/1965 | Salminen | |
| 3,491,908 | A | 1/1970 | Beimers | |
| 3,596,694 | A | 8/1971 | Jaeniche | |
| 3,603,472 | A | 9/1971 | Lecinski, Jr. et al. | |
| 3,771,681 | A | 11/1973 | Mart | |
| 3,861,550 | A | 1/1975 | Taylor et al. | |
| 3,868,038 | A | 2/1975 | Hadley | |
| 3,880,313 | A | 4/1975 | Akers | |
| 3,880,314 | A | 4/1975 | Akers | |
| 3,883,025 | A | 5/1975 | Jemmett | |
| 4,036,388 | A | 7/1977 | Davidson | |

(Continued)

FOREIGN PATENT DOCUMENTS

| | | |
|---|---|---|
| DE | 1 955 161 | 5/1971 |
| EP | 0 460 813 A2 | 12/1991 |

(Continued)

OTHER PUBLICATIONS

International Search Report and Written Opinion issued in International Application No. PCT/US2006/062677, mailed Sep. 17, 2007.

(Continued)

*Primary Examiner* — Anthony Stashick
*Assistant Examiner* — James N Smalley
(74) *Attorney, Agent, or Firm* — Cook Alex Ltd.

(57) ABSTRACT

Retortable packages including plastic closure caps are disclosed. The closure cap includes an end panel and a liner applied to the end panel. The finish contacting surface of the liner has a profile that is generally arc-shaped or torroidal-like prior to contact with the finish.

22 Claims, 12 Drawing Sheets

(56) References Cited

U.S. PATENT DOCUMENTS

| | | | | |
|---|---|---|---|---|
| 4,106,654 | A | 8/1978 | Jones | |
| 4,202,455 | A | 5/1980 | Faulstich | |
| 4,210,251 | A | 7/1980 | Grussen | |
| 4,256,234 | A | 3/1981 | Mori et al. | |
| 4,343,408 | A | 8/1982 | Csaszar | |
| 4,444,325 | A | 4/1984 | Lecinski, Jr. | |
| 4,444,327 | A | 4/1984 | Hedgewick | |
| 4,461,390 | A | 7/1984 | Csaszar | |
| 4,473,163 | A * | 9/1984 | Geiger | 215/250 |
| 4,479,586 | A | 10/1984 | Csaszar | |
| 4,487,325 | A | 12/1984 | Willingham | |
| 4,489,845 | A | 12/1984 | Aichinger et al. | |
| 4,550,841 | A | 11/1985 | Sandhaus | |
| 4,572,387 | A | 2/1986 | Luker et al. | |
| 4,609,115 | A | 9/1986 | Moore et al. | |
| 4,613,052 | A | 9/1986 | Gregory et al. | |
| 4,640,428 | A | 2/1987 | Chang | |
| 4,674,642 | A | 6/1987 | Towns et al. | |
| 4,682,700 | A | 7/1987 | Montgomery et al. | |
| 4,697,716 | A | 10/1987 | Mumford | |
| 4,721,220 | A | 1/1988 | Northup | |
| 4,721,221 | A | 1/1988 | Barriac | |
| 4,723,678 | A | 2/1988 | Kollen et al. | |
| 4,723,685 | A | 2/1988 | Fillmore et al. | |
| 4,785,963 | A | 11/1988 | Magley | |
| 4,813,561 | A | 3/1989 | Ochs | |
| 4,896,782 | A | 1/1990 | Hawkins et al. | |
| 5,020,683 | A | 6/1991 | Strassheimer | |
| 5,031,787 | A | 7/1991 | Ochs | |
| 5,064,084 | A | 11/1991 | McBride et al. | |
| 5,135,124 | A | 8/1992 | Wobser | |
| 5,143,763 | A * | 9/1992 | Yamada et al. | 428/36.2 |
| 5,265,747 | A | 11/1993 | Gregory et al. | |
| 5,285,913 | A | 2/1994 | Morton | |
| 5,318,192 | A | 6/1994 | Rebeyrolle et al. | |
| 5,346,082 | A | 9/1994 | Ochs et al. | |
| 5,421,470 | A | 6/1995 | Dudzik | |
| 5,462,187 | A | 10/1995 | Gregory et al. | |
| 5,579,936 | A | 12/1996 | Costa et al. | |
| 5,650,113 | A | 7/1997 | Gregory et al. | |
| 5,660,290 | A | 8/1997 | Hayes | |
| 5,685,443 | A | 11/1997 | Taber et al. | |
| 5,692,628 | A | 12/1997 | Montgomery et al. | |
| 5,730,306 | A | 3/1998 | Costa et al. | |
| 5,788,101 | A | 8/1998 | King | |
| 5,806,700 | A | 9/1998 | Henning | |
| 5,819,976 | A | 10/1998 | Boehm et al. | |
| 5,839,592 | A | 11/1998 | Hayes | |
| 5,853,097 | A | 12/1998 | Ekkert | |
| 5,860,542 | A | 1/1999 | Takamatsu | |
| 5,884,788 | A | 3/1999 | Wilde | |
| 5,924,586 | A | 7/1999 | Gregory et al. | |
| 5,927,532 | A | 7/1999 | Traub | |
| 5,947,311 | A | 9/1999 | Gregory | |
| 5,957,315 | A | 9/1999 | Kaitsuka | |
| 5,964,362 | A | 10/1999 | Sandor et al. | |
| 5,967,351 | A | 10/1999 | Ekkert | |
| 5,975,322 | A | 11/1999 | Reid | |
| 5,979,683 | A | 11/1999 | Kobayashi et al. | |
| 5,984,124 | A | 11/1999 | Takano | |
| 6,003,699 | A | 12/1999 | Laszlo et al. | |
| 6,021,912 | A | 2/2000 | Hertrampf | |
| 6,056,136 | A | 5/2000 | Taber et al. | |
| 6,095,359 | A | 8/2000 | Richmond | |
| 6,103,170 | A | 8/2000 | Gregory | |
| 6,109,465 | A | 8/2000 | Henning | |
| 6,119,883 | A | 9/2000 | Hock et al. | |
| 6,152,316 | A | 11/2000 | Niese | |
| 6,164,503 | A | 12/2000 | Forsyth et al. | |
| 6,202,871 | B1 | 3/2001 | Kelly | |
| 6,220,466 | B1 | 4/2001 | Hayes et al. | |
| 6,234,335 | B1 | 5/2001 | Gee et al. | |
| 6,241,111 | B1 | 6/2001 | Sandor et al. | |
| 6,253,940 | B1 | 7/2001 | Graham et al. | |
| 6,257,432 | B1 | 7/2001 | Ekkert | |
| 6,260,722 | B1 | 7/2001 | Ekkert | |
| 6,276,543 | B1 | 8/2001 | German et al. | |
| 6,325,226 | B1 | 12/2001 | Krautkramer | |
| 6,354,450 | B1 | 3/2002 | Zielinski et al. | |
| 6,371,318 | B1 | 4/2002 | Riffer | |
| 6,378,713 | B2 | 4/2002 | Montgomery | |
| 6,399,170 | B1 | 6/2002 | Hock et al. | |
| 6,446,823 | B2 | 9/2002 | Miceli et al. | |
| 6,488,165 | B1 | 12/2002 | Hidding | |
| 6,491,175 | B1 | 12/2002 | Taha | |
| 6,527,132 | B1 | 3/2003 | Druitt et al. | |
| 6,536,616 | B2 | 3/2003 | Sandor et al. | |
| 6,581,793 | B1 | 6/2003 | Racine et al. | |
| 6,626,310 | B2 | 9/2003 | Taha | |
| 6,659,297 | B2 | 12/2003 | Gregory et al. | |
| 6,660,349 | B1 | 12/2003 | Bourgeois | |
| 6,677,016 | B2 | 1/2004 | Riffer | |
| 6,695,161 | B2 | 2/2004 | Kano et al. | |
| 6,696,123 | B2 | 2/2004 | Hock et al. | |
| 6,702,133 | B1 | 3/2004 | Shenkar et al. | |
| 6,702,134 | B2 | 3/2004 | Scalese et al. | |
| 6,779,672 | B2 | 8/2004 | Kano et al. | |
| 6,874,647 | B2 | 4/2005 | Bloom et al. | |
| 7,611,026 | B1 * | 11/2009 | Bloom et al. | 215/276 |
| 2001/0019033 | A1 | 9/2001 | Montgomery | |
| 2002/0000420 | A1 | 1/2002 | Taha | |
| 2002/0043512 | A1 | 4/2002 | Sandor et al. | |
| 2002/0104818 | A1 | 8/2002 | Riffer | |
| 2002/0144971 | A1 | 10/2002 | Nilstoft et al. | |
| 2002/0158037 | A1 | 10/2002 | Kano et al. | |
| 2003/0015490 | A1 | 1/2003 | Taha | |
| 2003/0057175 | A1 | 3/2003 | Willingham et al. | |
| 2003/0098285 | A1 | 5/2003 | Gregory et al. | |
| 2003/0098286 | A1 * | 5/2003 | Bloom et al. | 215/349 |
| 2003/0098287 | A1 | 5/2003 | Taber et al. | |
| 2003/0116522 | A1 | 6/2003 | Julian et al. | |
| 2003/0141271 | A1 | 7/2003 | German et al. | |
| 2003/0146185 | A1 | 8/2003 | Francois et al. | |
| 2003/0222046 | A1 | 12/2003 | Schenck et al. | |
| 2004/0035818 | A1 | 2/2004 | King | |
| 2004/0055990 | A1 | 3/2004 | Dubach | |
| 2004/0060893 | A1 | 4/2004 | Kano et al. | |
| 2004/0060894 | A1 | 4/2004 | Parrinello | |
| 2004/0065977 | A1 | 4/2004 | Bron et al. | |
| 2004/0069738 | A1 | 4/2004 | Orth et al. | |
| 2004/0069739 | A1 | 4/2004 | Zumbuhl | |
| 2004/0108294 | A1 * | 6/2004 | Bloom et al. | 215/276 |
| 2004/0155007 | A1 | 8/2004 | Hearld et al. | |
| 2004/0161560 | A1 | 8/2004 | Baranowski et al. | |
| 2005/0029219 | A1 | 2/2005 | Taber et al. | |
| 2005/0061766 | A1 | 3/2005 | Jochem | |
| 2005/0098529 | A1 | 5/2005 | Bloom et al. | |

FOREIGN PATENT DOCUMENTS

| | | | |
|---|---|---|---|
| EP | 0 987 187 | A1 | 3/2000 |
| EP | 1 481 908 | A1 | 12/2004 |
| GB | 786282 | | 11/1957 |
| GB | 801925 | | 9/1958 |
| GB | 2 233 635 | A | 1/1991 |
| GB | 2 358 626 | A | 8/2001 |
| JP | 54-12872 | | 5/1979 |
| JP | 56-31559 | | 7/1981 |
| JP | 56-31560 | | 7/1981 |
| JP | 61-152563 | | 7/1986 |
| WO | WO 85/00153 | | 1/1985 |
| WO | WO 85/02164 | | 5/1985 |
| WO | WO 91/06486 | | 5/1991 |

OTHER PUBLICATIONS

English translation of claim 1 from reference DE 1955161, which was cited in the International Search Report issued in International Application No. PCT/US2006/062677, mailed Sep. 17, 2007.

Partial International Search, International Application No. PCT/US2006/062677, mailed Jun. 20, 2007.

* cited by examiner

RETORTABLE PACKAGE WITH PLASTIC CLOSURE CAP

This application claims the benefit of U.S. Provisional Patent Application Ser. No. 60/754,477, filed Dec. 28, 2005, the contents of which are hereby incorporated by reference.

The present invention is directed to food or beverage packages including a closure cap and container such as, for example, plastic bottles and jars. More particularly, the present invention is directed to packages including a closure cap such as, for example, a composite closure, with an end panel made substantially of plastic, having oxygen barrier properties and providing a hermetic seal between the container and the cap in a variety of sealing and sterilization environments, including retort.

BACKGROUND OF THE INVENTION

Certain food or beverage-containing packages include products that are either hot filled, thermally pasteurized or sterilized after filling, and/or products where the entire package (filled container sealed with a closure applied thereon) is subjected to "retorting" (i.e., heating the package to a temperature greater than 220° F.). Plastic containers and, more particularly, the plastic container finishes that are subjected to retort or other high temperature processes often undergo expansion and subsequent contraction. The expansion and contraction of the container finish can often affect the integrity of the seal between the container and the closure, thus making it possible for the product to become contaminated or otherwise negatively affected.

Composite closures have commonly been used with packages that are subjected to retort or other high temperature applications. Composite closures typically include, an annular shell or ring with a central opening and a separate end panel occupying the central opening. Many of the currently available composite closures include a metal end panel and an annular gasket or liner of sealant that provides a hermetic seal between the closure and the container finish. In addition to being effective in maintaining seal integrity during retort, the metal end panel of the metal/plastic composite closure provides a good barrier to oxygen which, if allowed to freely permeate the package, can result in spoilage of the food product.

Recently, composite closures where the end panel is made substantially of a non-metal material, such as plastic, have been disclosed. Such "all-plastic" composite closures have the advantage of the end panel being less susceptible to corrosion and are more economical to manufacture. Even more recently, "one-piece" closures (i.e., non-composite closures) in retort or other high temperature applications have also been disclosed. One example of such a closure is provided in U.S. Pat. No. 6,702,133.

Maintaining the integrity of the seal can be particularly problematic in food products packaged in plastic containers that are subjected to retorting. Thus, there is a continuing need for a closure and package with a closure that can be subjected to retort while maintaining the integrity of the seal. In addition, there exists a continuing need to provide a retortable package that (1) seals the package to further limit oxygen ingress at the interface of the container finish and closure cap, (2) effectively limits the ingress of oxygen through the closure, (3) provides evidence of tampering and reduces the risk of tampering, and (4) reduces the cost of manufacture. The packages and closures of the present invention address the above-stated needs.

SUMMARY

In one aspect, the present disclosure is directed to a composite closure cap for a container. The closure cap includes a plastic shell that has a generally inwardly extending annular top flange and a radially outer, downwardly depending skirt extending from the flange. The inwardly extending flange defines a central opening in the shell. The closure cap also includes an at least substantially plastic end panel held within the shell, the end panel having a top surface and a bottom surface and a central portion overlying the central opening and a radially outer upwardly extending portion extending from the central portion wherein the bottom surface of the end panel at the upwardly extending portion provides a liner receiving surface. A liner is applied to the liner receiving surface, the liner including a finish contacting surface that has a generally torroidal-like shaped profile prior to contact with a finish.

In another aspect, the present disclosure is directed to a closure cap for a container wherein the closure includes a plastic shell, the shell having a generally inwardly extending annular top flange and a radially outer, downwardly depending skirt extending from the flange. The flange defines a central opening in the shell. The closure further includes an at least substantially plastic end panel held within the shell. The end panel includes a top surface and a bottom surface. The end panel has a central portion and a radially outer peripheral portion with a downwardly extending plug between the central and radially outer peripheral portions. A liner is applied to the radially outer surface of the plug and has a finish contacting surface with a generally torroidal-like shaped profile prior to contact with the finish.

In another aspect, the present disclosure is directed to a plastic closure cap including a plastic shell having an integral end panel and a downwardly extending skirt portion. The end panel has a top surface and a bottom surface and includes a central portion and a radially outer upwardly extending wall portion extending from the central portion. The bottom surface of the end panel at the radially outer, upwardly extending wall portion provides a liner receiving surface, and a liner is applied to the liner receiving surface. The finish contacting outer surface of the liner has a generally torroidal-like shaped profile prior to contact with a finish.

In another aspect, the present disclosure is directed to a package including a container finish and a closure cap. The closure cap has a plastic shell and an end panel having a top surface and a bottom surface. The bottom surface of the end panel includes a portion to which the liner is applied. The outer surface of the liner that contacts the container finish has a generally torroidal-like shaped profile prior to such contact.

In another aspect, the present disclosure is directed to a package. The package includes a closure having an end panel, a downwardly extending skirt and a tamper-evidencing band having a plurality of at least substantially continuous ratchets. The package also includes a container with a container finish wherein a plurality of ratchet groups annularly spaced around the container finish. The ratchet groups are separated by an outwardly extending bead. The bead has an outer diameter such that the ratchet tips on the closure opposite the bead contact the bead when the closure is fully applied to the container.

In another aspect, the present disclosure is directed to a closure for a container wherein the closure includes an end panel and a downwardly extending skirt. The end panel has a top surface and a bottom surface, a central portion and an outer peripheral portion. At least the central portion includes a material having oxygen barrier properties.

In a further aspect, the present disclosure is directed to a closure for a container wherein the container has a shell including a downwardly extending skirt. A tamper-evidencing band is attached to the terminal end of the skirt by a plurality of bridges. The bridges are of at least two different types and one type of bridge is adapted to fracture before the second type of bridge fractures during opening of the container.

These and other aspects of the present invention are described in greater detail below.

DESCRIPTION OF THE EMBODIMENTS

Figure 10:
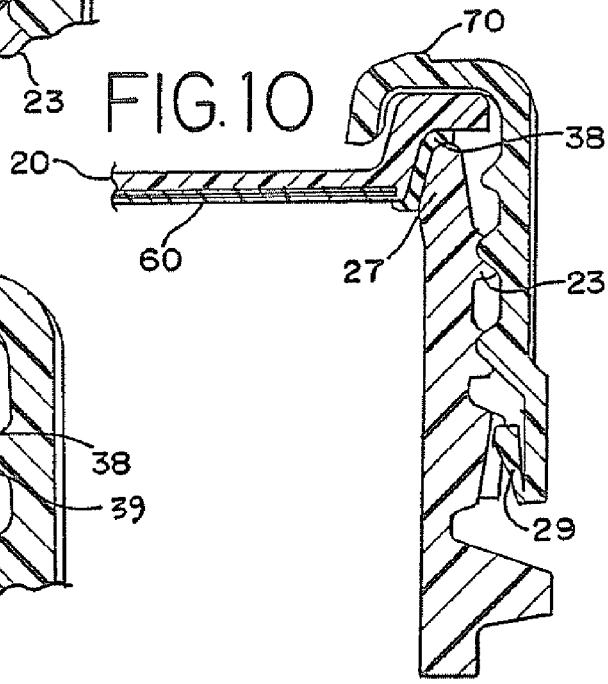
FIG. 10 is a partial cross-sectional side view of the package of FIG. 9 in the fully sealed condition.
Figure 11:
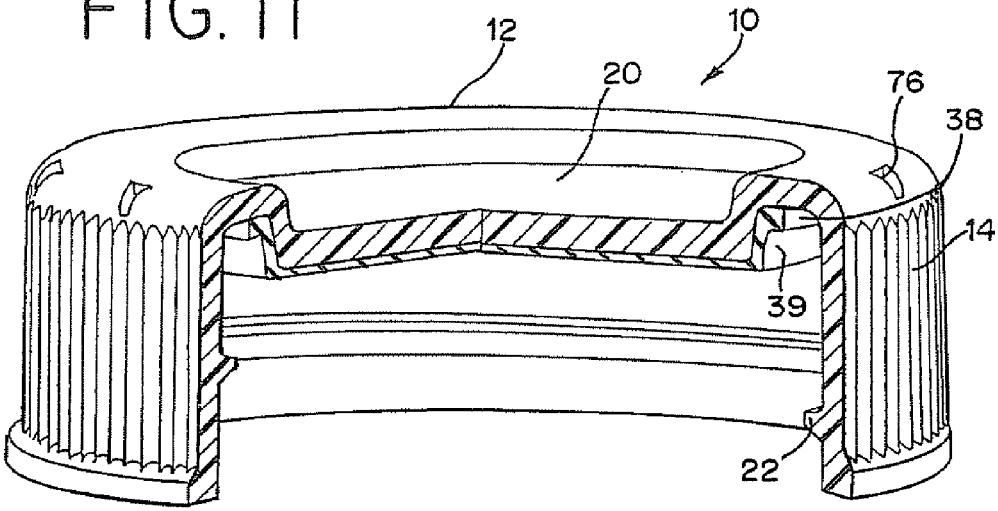
FIG. 11 is a perspective view of one-piece retortable closure embodying the present invention with a section broken away to show the end panel with a liner.
Figure 12:
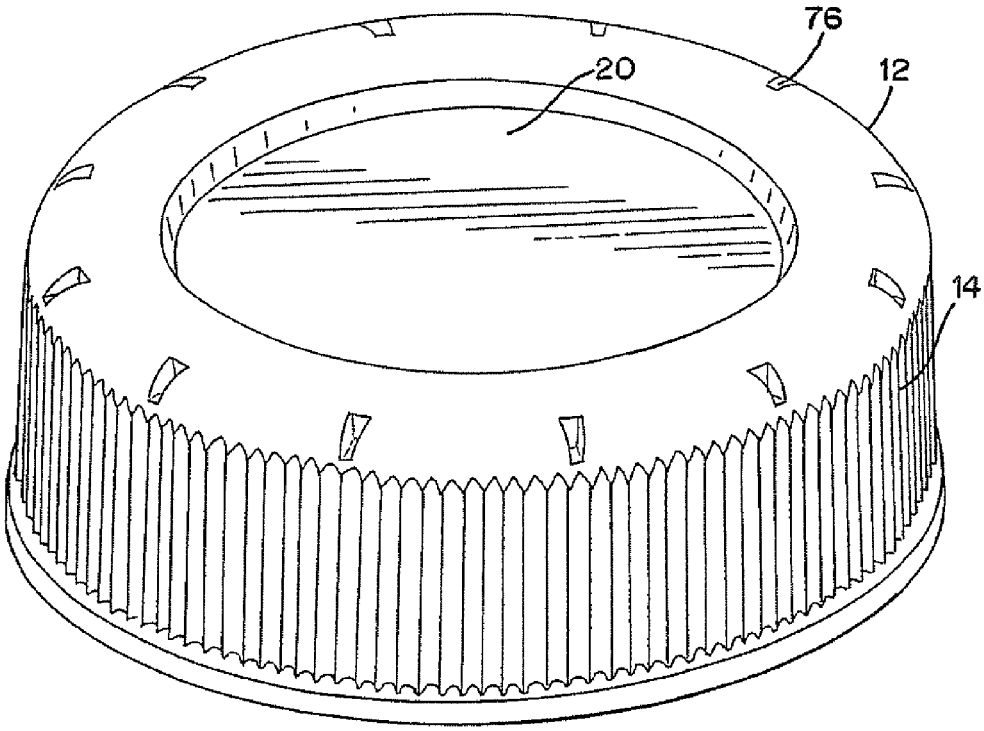
FIG. 12 is a perspective view of the closure shell of FIG. 11.

With reference to FIGS. 1-10, closure cap 10 may be a composite closure that includes a generally cylindrical shell 12 having a central opening 13 (FIG. 2) covered by a separate end panel 20 held within shell 12. Alternatively, as shown in FIGS. 11 and 12, closure 10 may be a "one-piece" closure having a shell 12 and an integral end panel 20. In either embodiment, shell 12 is preferably molded from a plastic material such as, for example, polypropylene.

As shown in the FIGS. 1-10 and 13-14, shell 12 includes a downwardly extending skirt 14 integrally formed with an upper radially and inwardly extending flange 18. In the embodiment of FIGS. 1-10, flange 18 may include a radially inner downwardly depending lip 18*a*.

Figure 1:
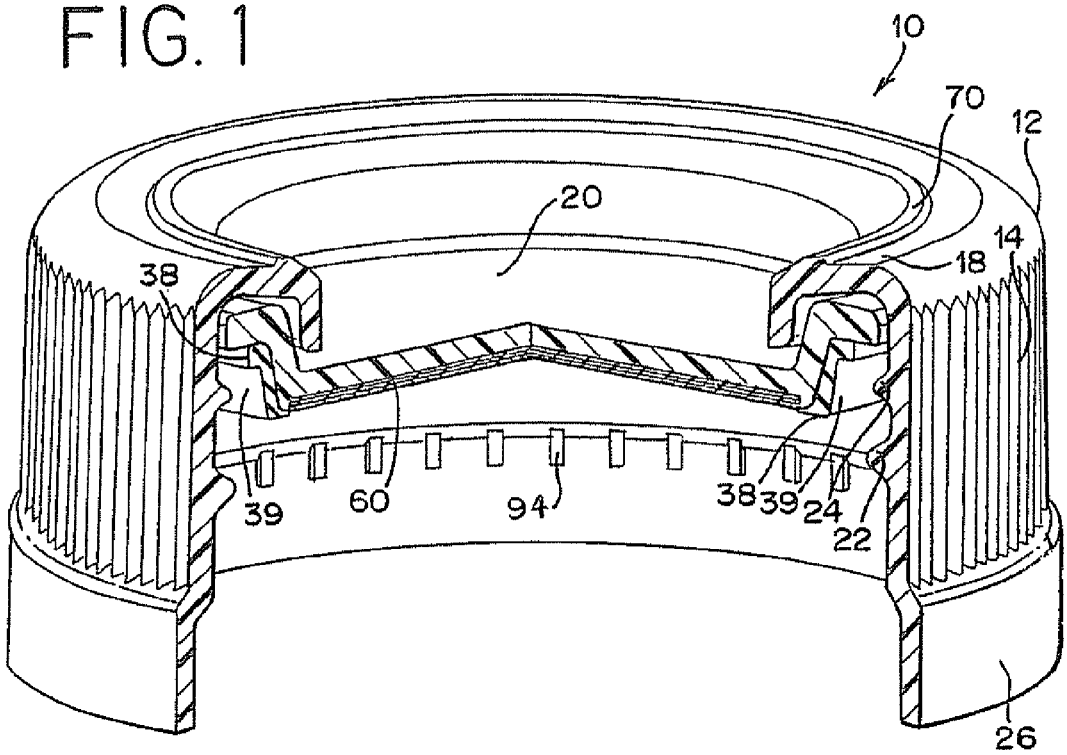
FIG. 1 is a perspective view of one embodiment of a composite closure of the present invention with a section broken away to show the end panel lined with a ring (gasket) of sealant.
Figure 4:
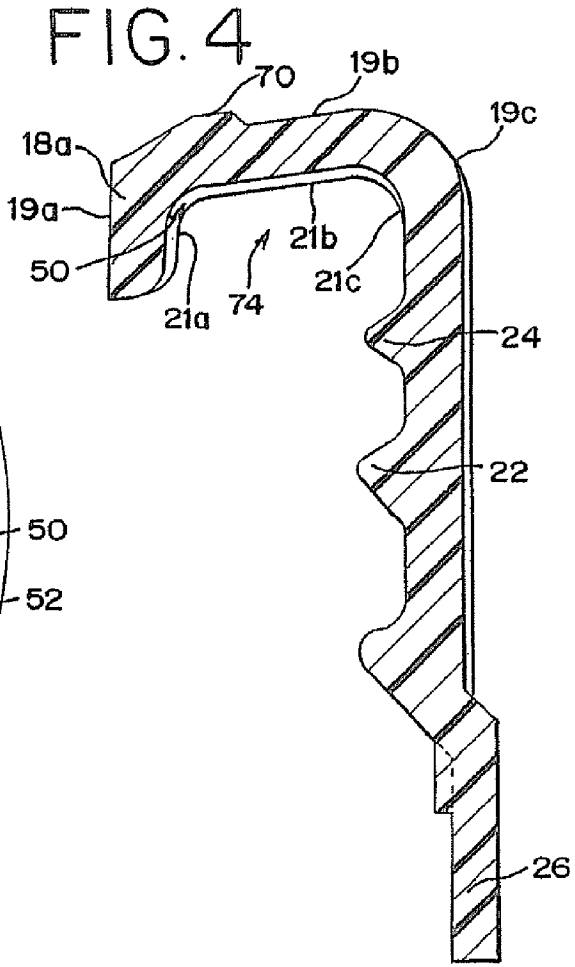
FIG. 4 is a partial cross-sectional side view of the closure cap shell.
Figure 3:
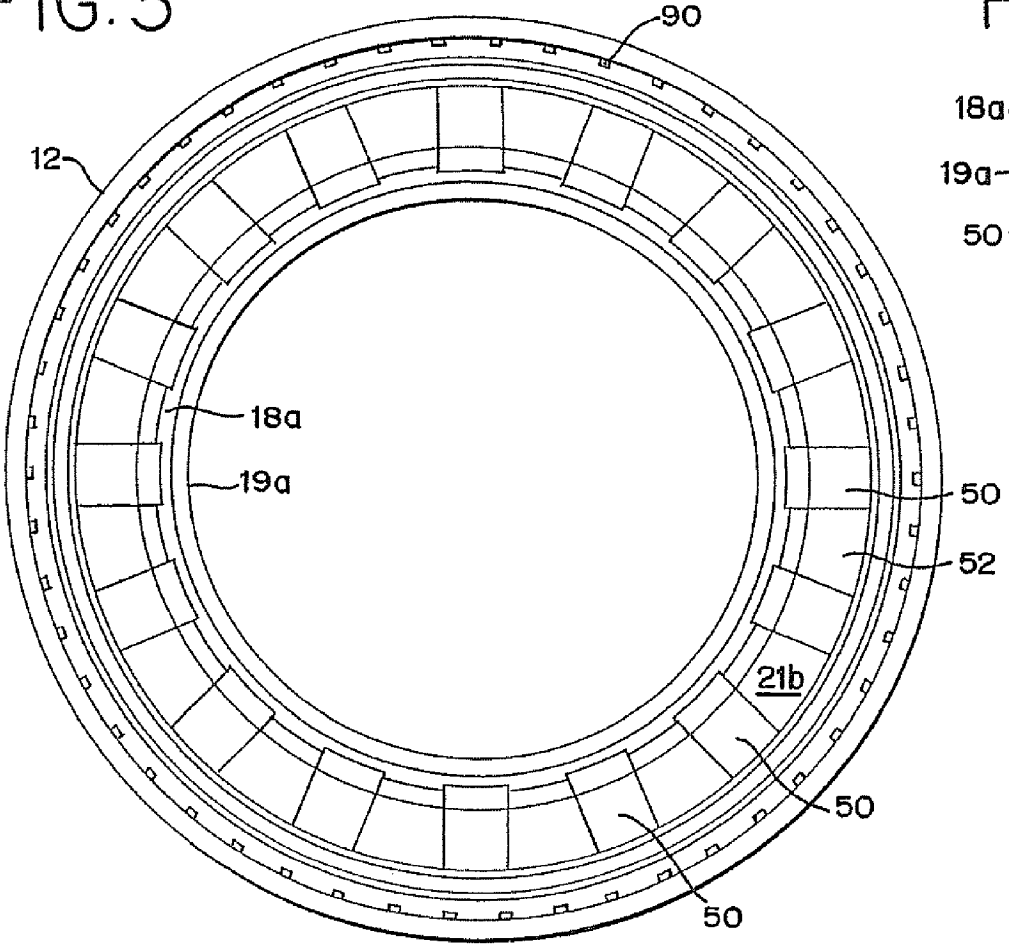
FIG. 3 is a bottom view of the closure cap shell.
Figure 8:
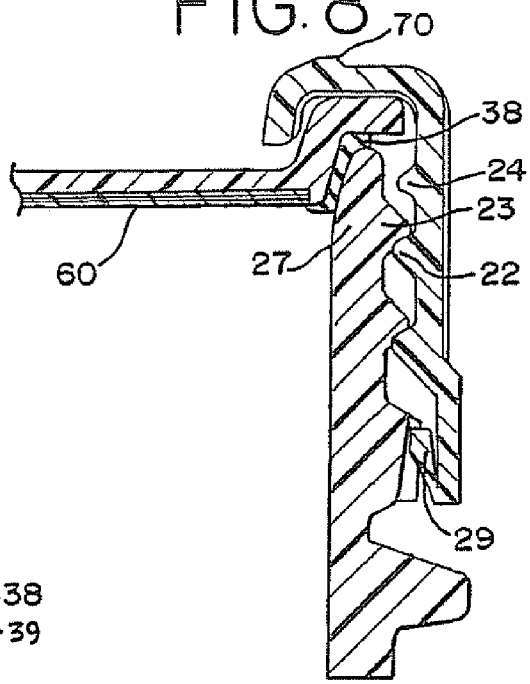
FIG. 8 is a partial cross-sectional side view of the package in the fully sealed condition.

As shown in FIGS. 1 and 4, although also applicable to the embodiment of FIGS. 11-14, the inner circumferential surface of skirt 14 is provided with one or more preformed threads 22. Thread 22 is intended for cooperative mating engagement with corresponding thread(s) 23 on the container finish 27, as generally depicted in FIGS. 8 and 10, and elsewhere. In a preferred embodiment, thread 22 is a single lead thread that extends more than 360° on the inner surface of shell 12. Alternatively, thread 22 may also be a multi-lead thread.

Figure 2:
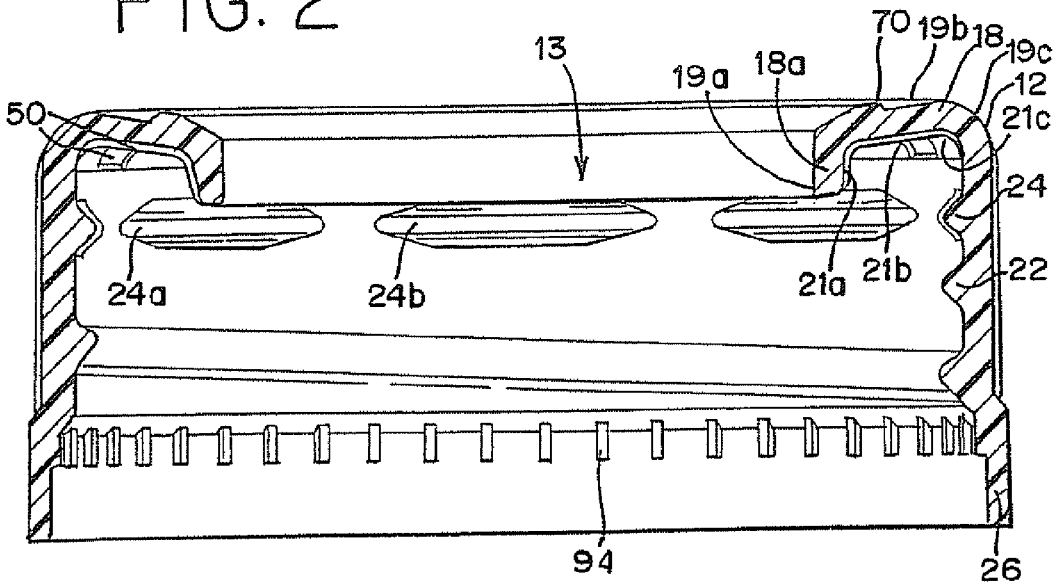
FIG. 2 is a cross-sectional side view of the closure shell of FIG. 1.

In the embodiment of FIGS. 1-10 and 13-14, the inner circumferential surface of skirt 14 includes, preferably, lifting bead 24, which is located above thread 22 and, more specifically, above the upper terminal end of thread 22. Where a separate end panel 20 is provided, lifting bead 24 lifts end panel 20 and releases it from its sealing contact with the container during the opening sequence. In a preferred embodiment, lifting bead 24 is substantially horizontal (i.e., does not slope). In one embodiment, bead 24 may extend around the entire circumference of shell 12 (i.e., 360°). More preferably, bead 24 may extend less than 360° around shell 12. In one embodiment, lifting bead 24 extends approximately 240° or less around ring 12 and is continuous (i.e., uninterrupted). However, as shown in FIG. 2, lifting bead may also be non-continuous and be made up of a series of annular bead segments 24*a*, 24*b*, etc.

Alternatively, shell 12 may be provided without lifting bead 24. Where bead 24 is absent, release of end panel 20 from the container may be assisted by the lifting action of one of the threads 22. This provides for more distance between disc 20 and the lifting means (i.e., thread 22), thereby maximizing the travel distance of shell 12 before the primary seal of the package is broken. This may be advantageous where more sequential opening is desired.

Figure 32:
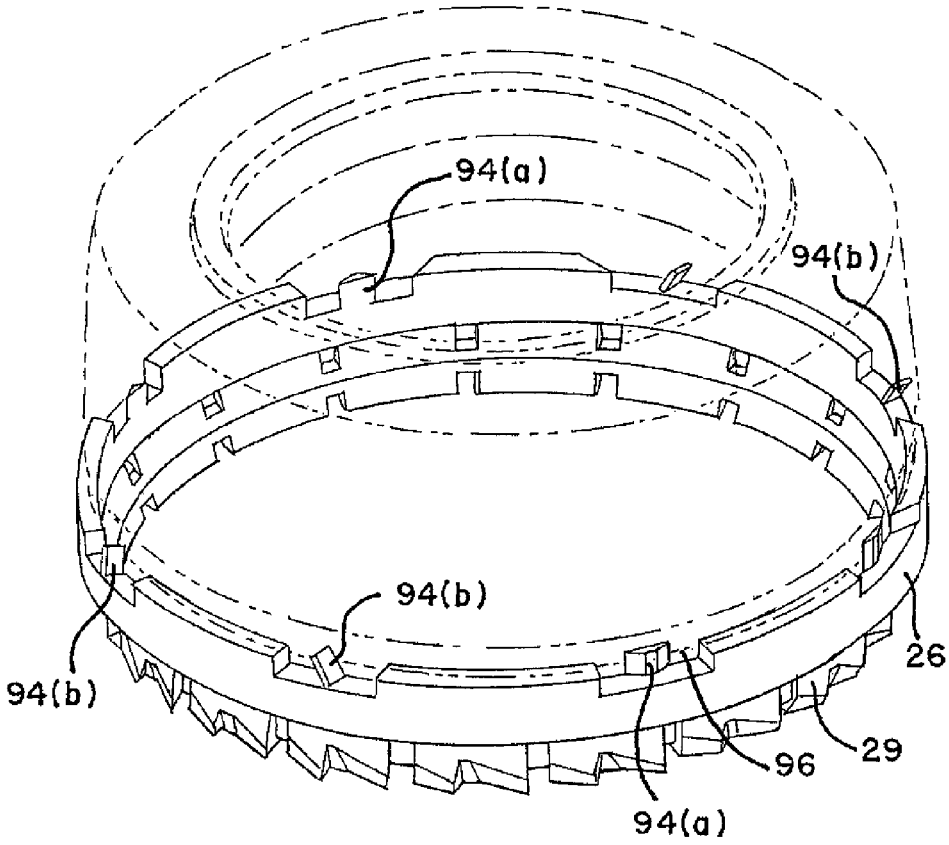
FIG. 32 is a perspective view of the tamper evidencing band with bridges joining the band to the closure skirt.

The closures depicted in FIGS. 1-14 preferably include a tamper-evidencing band 26 attached to the terminal end of skirt 14 is a tamper evident band 26. In a preferred embodiment, band 26 may be an extension of skirt 14 and/or be otherwise attached to skirt 14 by a plurality of bridges 94. A continuous or semi-continuous slit or line of weakening between skirt 14 and band 26 may be provided to allow for separation of the cap from band 26 during opening. Alternatively, cap may include bridges 94 formed by molding, as shown in FIG. 32 and described in greater detail below, or by an interrupted blade method (not shown). In any event, it will be appreciated that there are a number of ways, known to those of skill in the art, of providing fracturable bridges.

Band 26 may further include an upwardly and annular inwardly extending retaining member 29 for engagement of, for example, with the container finish 27 (See FIGS. 8 and 10). An example of this type of tamper evident band is disclosed in U.S. Pat. No. 5,685,443, incorporated herein by reference. Retaining member 29 may include a series of annular ratchets or ratchet groups that engage corresponding ratchets on the finish 27 of the container. In general, such ratchet engagement is well known and will be understood by those of skill in the art. A further discussion of the tamper band and ratchet engagement between the tamper band 26 and container is set forth below.

Where the closure is provided with a separate end panel 20 (i.e., a composite closure), the outside diameter of end panel 20 is slightly greater than the diameter of lifting bead 24 which allows end panel 20 to rest flat on the lifting bead 24 when closure 10 is in the assembled state but prior to application of the assembled closure to a container finish. Thus, end panel 20 is free-floating between lifting bead 24 and the bottom surface (e.g., 21(B)) of flange 18 (FIG. 2).

In one embodiment, end panel 20 may be made of any suitable material such as plastic or metal, but preferably is made at least substantially of plastic, and more preferably, entirely of plastic. End panel 20 may be made of any plastic composition or material suitable for use with food or beverage products, and may be provided as a single layer or, a two or more layers (laminated or otherwise joined) of plastic or other material. In one embodiment, end panel 20 may be made of a plastic material, such as polypropylene, or a blend that includes polypropylene. A molded piece of a single material is preferred, (which can be over-molded or otherwise combined with an oxygen barrier film, described below). Preferably, end panel 20 may be injection molded. In an alternative embodiment described in more detail below, end panel 20 may be thermoformed.

Figure 5:
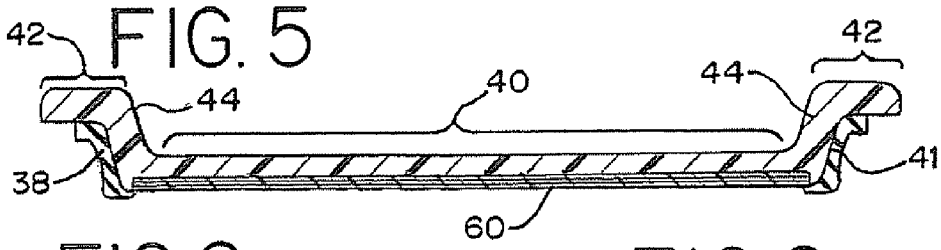
FIG. 5 is a cross-sectional side view of a end panel with the liner (gasket) applied to the radially outer, peripheral portion of the end panel bottom surface.

As shown in FIG. 5, in one embodiment, end panel 20 may be provided as a preformed disk having a selected thickness to provide end panel 20 with sufficient stiffness and rigidity such that it substantially maintains its shape and provides support for the container finish during retort. Without being limited to any particular thickness, in one embodiment an end panel thickness of approximately 0.020-0.100 inch is suitable, with an end panel thickness of 0.03-0.07 inch being generally preferred.

As further shown in FIG. 5, end panel 20 may have a generally flat central portion 40 and a radially outer peripheral portion 42. End panel may further include a generally upwardly extending wall segment 44 between the central portion 40 and the radially outer, peripheral portion 42 of the end panel 20. The radially outer surface of wall segment 44 provides a liner receiving surface 41, described in greater detail below. The overall shape of end panel 20 described above will be substantially the same regardless of whether end panel 20 is separately provided or is integral with shell 12 as shown in the embodiment of FIGS. 11 and 12.

Figure 19:
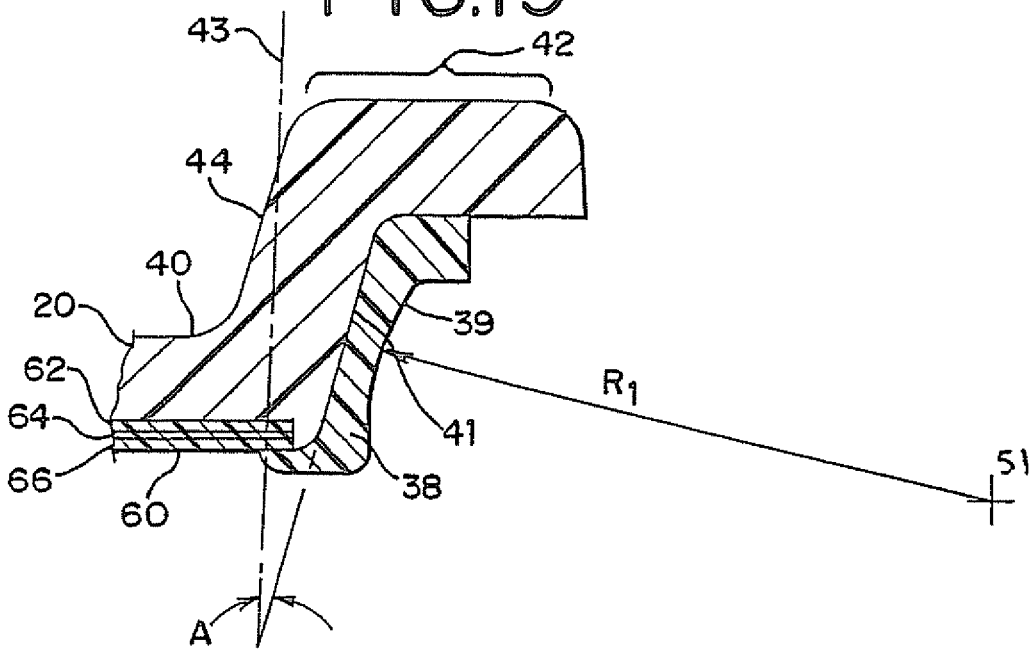
FIG. 19 is an enlarged, partial, cross-sectional side view of the end panel with the liner applied thereon, the liner having a generally semi-toroidal finish contacting surface profile.

As best seen in FIGS. 5 and 19 (which disclosure is also applicable to the embodiment of FIGS. 11 and 12), upwardly extending wall segment or shoulder 44 and, more specifically, liner receiving surface 41, extend upwardly and radially outwardly (preferably at an angle $A_1$ of approximately 10°-20° relative to vertical line 43) between the central portion 40 to the outer peripheral portion 42 of end panel 20. Alternatively, liner receiving surface 41 may be substantially vertical. In another embodiment, shown in FIGS. 13 and 14, wall segment 44 may be provided in the form of a downwardly extending plug 46 that extends from the end panel 20, between central portion 42 and peripheral portion 42. Plug 46 provides a liner receiving surface 47 on the radially outer surface thereof. As in the embodiment of FIG. 5, the outer surface of plug 46 is angled ($A_1$) (approximately 10°-20° relative to vertical line 43), but may also be substantially vertical. The end panel 20 shown in FIGS. 13 and 14 may also include supporting ribs 49 to provide end panel 20 with additional stiffness.

In one embodiment, end panel 20, whether separately provided or integral with shell 12, may further include or incorporate a film 60 of material having oxygen barrier and/or oxygen scavenging properties. The oxygen barrier film 60, which is preferably provided in the form of a circular disk, may be incorporated with a surface of end panel 20, preferably substantially within the central portion 40 of end panel 20. Film 60 may be made of a single layer of one or more plastic materials, wherein at least one of the materials is an oxygen barrier and/or oxygen scavenger. More preferably, film 60 may be a multi-layered film wherein at least one of the layers includes or is made of an oxygen barrier material and/or includes an oxygen scavenger.

Figure 14:
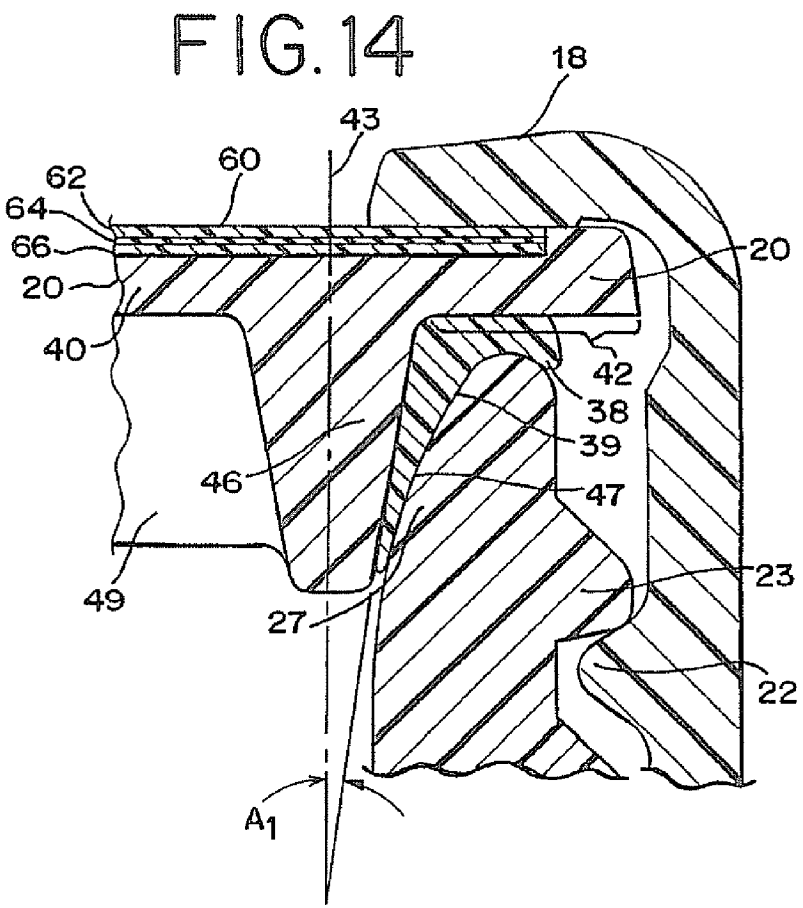
FIG. 14 is a partial, cross-sectional side view of the composite closure and finish of FIG. 13 when the package is fully sealed.
Figure 13:
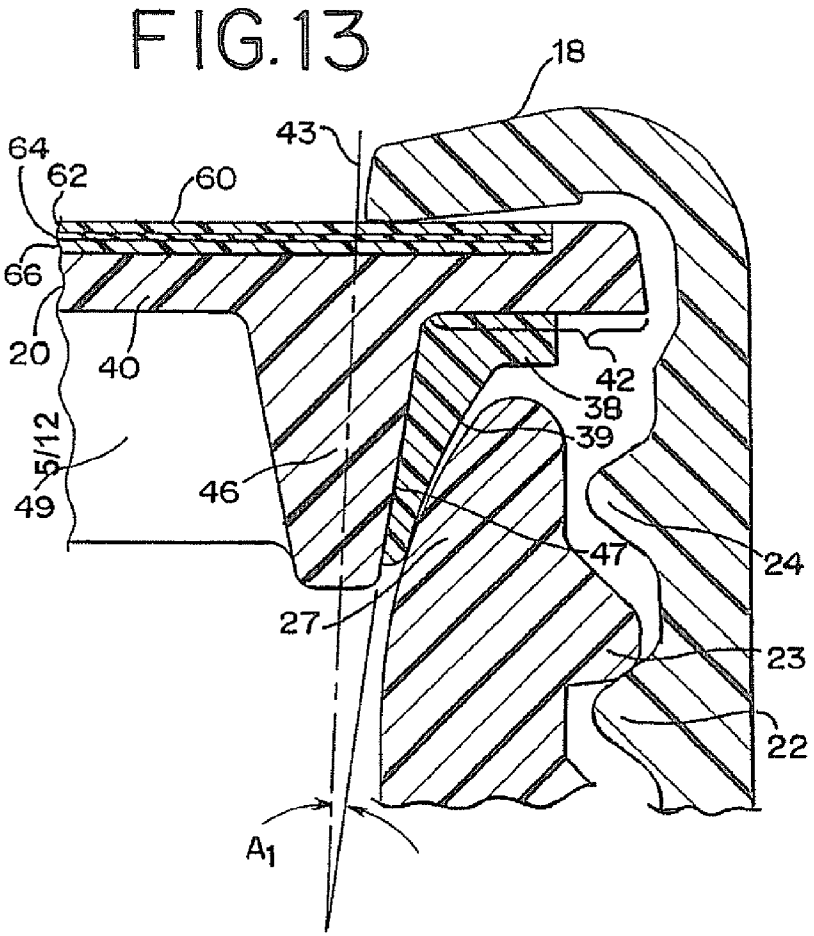
FIG. 13 is a partial, cross-sectional side view of another alternative composite closure with an end panel including a plug extending therefrom during initial contact of the finish with the closure liner.

As shown in Figures, film 60 may be incorporated either with the top surface (as shown, for example, in FIGS. 13 and 14) or bottom surface (as shown in FIGS. 1, 5-10 and 19) of end panel 20, preferably within central portion 40 of end panel 20. (Although FIGS. 13-14 show film 60 incorporated into the top surface of a "plug" type end panel, it will be understood that film 60 can also be incorporated with the top surface of an end panel of the type shown in FIGS. 1, 5-12, 19). One preferred form of incorporating film 60 into end panel 20 is by overmolding film 60 with the plastic material of end panel 20 or shell 12.

As indicated above, in a preferred embodiment, film 60 may be multi-layered. A multi-layered film, as shown, for example, in FIG. 6 and elsewhere, can be made by a variety of methods. In one embodiment, film 60 can be made from co-extruded sheets of multiple layers. In still another embodiment, film 60 can be made by molding, such as by injection molding.

Figure 6:
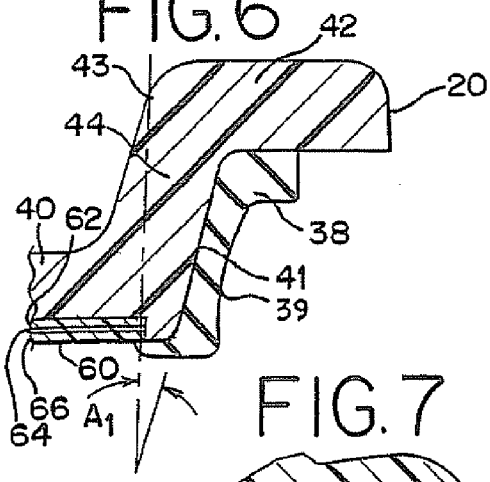
FIG. 6 is an enlarged partial cross-sectional view of the end panel and the liner applied thereon.

As shown in FIG. 6, for example, the multi-layered film may include at least top 62, middle 64 and bottom 66 layers of a plastic material, wherein at least one layer includes a material that has oxygen barrier properties. In one embodiment, top layer 62 may be made of a plastic material such as, for example, a polypropylene and/or polypropylene, polyethylene co-polymer. Middle layer 64 may be a compound with good oxygen barrier properties. For example, middle layer 64 may be an ethylene vinyl compound such as, but not limited to, EVOH. Bottom layer 66 may be a polypropylene or a polypropylene/polyethylene co-polymer. Additionally, where film 60 is a multi-layer film 60, it may include adhesive between the top and middle layers and between the bottom and middle layers. Including the adhesive layers, film 60 will typically have at least 5 layers and may have more than 5 layers.

Alternatively, the material having the oxygen barrier property may comprise top layer 62. Thus, in this alternative embodiment, top layer 62 may be an oxygen barrier, middle layer 64 may be a bonding layer and bottom layer 66 may be polypropylene, a copolymer thereof or other polymeric material with insubstantial oxygen barrier properties. In a further alternative embodiment, bottom layer 66 may be made of a material having the oxygen barrier property.

In a further alternative embodiment, film 60 may include a flexible organic barrier coating on a base film. One example of a flexible barrier coating is polyacrylic acid (PAA) coated onto a base film. Base film may be any plastic material onto which PAA may be coated. One example of a base film is polyethylene terephthalate (PET). Examples of such commercially available organic barrier coated films of the type described above include Besela® films available from Kureha Chemicals. Thus, in one embodiment, film 60 may include a top layer of the base layer (e.g., PET), a middle layer of the organic barrier coating (e.g., PAA) and a bottom layer of polypropylene and/or polypropylene/polyethylene copolymer. A film of the type described above is preferably incorporated into top surface of end panel 20 as generally shown in FIGS. 13 and 14 but may also be incorporated into the bottom surface of end panel 20 where the base layer is the bottom layer of film 60, the organic barrier coating is the middle layer and the layer in contact with the end panel 20 is preferably the polypropylene and/or polypropylene/polyethylene copolymer.

Although the thickness of film 60 will depend, in part, on the size of closure 10, in most of the embodiments described herein a film thickness of approximately 0.003-0.01 inch is preferred. In the embodiment, where the top and bottom layers are polypropylene or copolymers thereof with an intermediate layer of, for example, EVOH, the thickness of the intermediate layer will preferably be approximately 1-2 mils.

As indicated above, end panel 20 may be thermoformed. In one embodiment, end panel 20 may be made of multiple layers of the materials described above in connection with film 60, but having an overall thickness comparable to the overall thickness of end panel 20. Thus, for example, end panel 20 may have anywhere between 5-7 layers of different and alternating layers of material including outermost layers of a polypropylene/polyethylene copolymer and a middle layer of an oxygen barrier material such as, but not limited to EVOH. The thermoformed end panel 20 may further include layers of adhesive and/or of regrind material. As described above, thermoformed end panel may have an overall thickness of between approximately 0.02-0.10 inch with a thickness of 0.03-0.07 inch being particularly preferred.

In addition to or as a further alternative to the above, film 60 may include an oxygen scavenger. Preferably, the scavenger will be combined, blended or otherwise incorporated into a single-layer end panel or disc. Alternatively, where film 60 (or the entire end panel 20) is made of multiple layers, bottom layer 66 of film 60 or the bottom layer of multi-layered end panel 20 may include an oxygen scavenger so as to reduce head space oxygen levels after sealing of the container. Examples of suitable scavengers include fine sodium ascorbate particulate or powder. Other examples of oxygen scavengers include iron-based compounds, such as ferrous oxide. Using an oxygen scavenger with one or more layers of an oxygen barrier provides an active and passive barrier system.

Closure cap 10 preferably includes an annular gasket or liner 38 of a sealant which is sealingly engageable with the end face and preferably radially inner upper surface of the container finish 27. Liner 38 may be a full pad liner that substantially covers the entire bottom surface of panel 20 (as shown, for example, in FIG. 11). In a preferred embodiment, however, sealant is provided as a ring or gasket 38 on the bottom surface and around the outer periphery of end panel 20, as best seen in FIGS. 5 and 6. An example of a gasket and its method of manufacture and application is provided in U.S. patent application Ser. No. 09/634,182, filed Aug. 9, 2000, and U.S. Patent Application Publication No. 2003/0098287 A1, filed Jan. 9, 2003, both of which are incorporated herein by reference. Liner 38 is preferably applied to end panel 20 by molding (e.g., injection molding). Liner 38 provides an effective seal between end panel 20 and the end and radial inner surface of container finish 27. It will be understood that liner 38 may be applied by injection molding, or otherwise, to a separately provided end panel or to an end panel that is integral with shell 12.

Suitable compositions for use in the gasket or liner 38 are any compositions that can provide a hermetic seal with container finish 27. In one embodiment, the sealant may be made of polypropylene or copolymer thereof. Other known sealant compositions that may be used include a SEBS block copolymer. Thermoplastic elastomers or other compositions which have oxygen barrier properties to varying degrees may also be used. Such thermoplastic elastomers are disclosed in U.S. Pat. No. 6,677,397 and U.S. patent application Ser. No. 10/400,304, filed Mar. 27, 2003, both of which are incorporated herein by reference. Although any suitable TPE or TPE-based composition may be used for gasket 38, the preferred plastic compositions disclosed in Ser. No. 10/400,304 are particularly useful in the closures described herein.

As best seen in FIG. 6 and FIG. 19, the surface of liner 38 that contacts the container finish i.e., "finish contacting surface" 39 of liner 38 preferably has a generally arc-shaped or generally semi-toroidal surface profile or a profile defined by a compound angle rather than a straight line profile. By arc-shaped or semi-toroidal, what is meant is that the profile of the liner 38 and liner sealing surface 39 is not characterized by any single measurable angle relative to a vertical axis. As shown in FIG. 19, the surface profile of finish contacting surface 39 of liner 38 may be defined by a radius $R_1$ drawn from a pre-determined center point 51.

As further shown in FIG. 6, the thickness of liner 38 may typically be (but does not have to be) greatest where liner 38 is applied to the lower portion of wall segment 44 and (optionally) at or near the outer peripheral portion 42 of end panel 20. Between the lower portion of wall 44 and outer peripheral portion 42 of end panel 20 the liner may have a relatively reduced thickness and, the surface profile of liner 38 is generally arc-shaped, or semi-toroidal, or defined by a compound angle, as described above.

The above-described profile of liner 38 allows for initial contact between container finish 27 and liner 38 to occur near the bottom of wall 44 during the application sequence. As closure 10 is further applied onto container finish 27, sealing proceeds upwardly i.e., from the bottom of wall 44, in a direction toward the radially outer peripheral portion 42 of end panel 20.

In the embodiment shown in FIGS. 13 and 14, liner 38 likewise has a generally arc-shaped or semi-toroidal surface profile. In this embodiment, liner may include a portion of increased thickness near the juncture of plug 46 and the radially outer peripheral portion 42 of end panel 20. As in the embodiment of FIGS. 5 and 6 discussed above, initial contact between container finish and liner 38 occurs at or near the bottom portion of plug 46. Sealing proceeds from the bottom of plug 46 upwardly along the plug wall in a direction toward the radially outer peripheral portion 42 of end panel 20.

Figure 7:
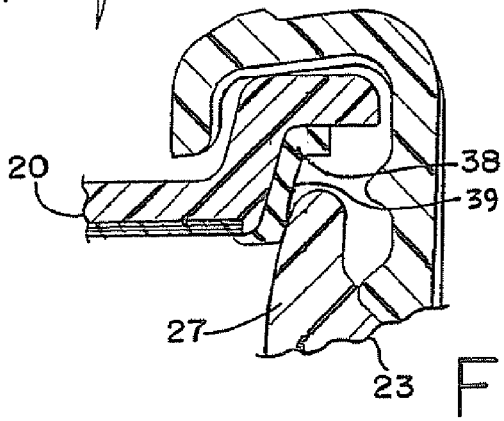
FIG. 7 is a cross-sectional side view of the closure cap as it initially contacts the container finish during application of the closure onto the finish.
Figure 9:
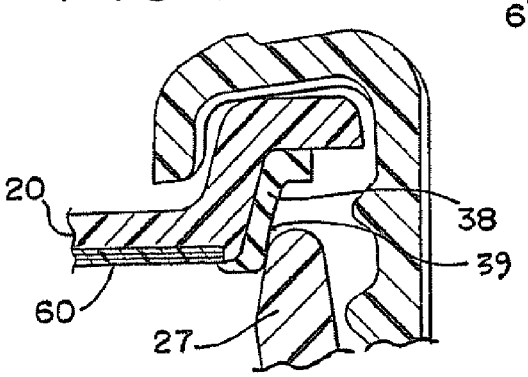
FIG. 9 is a partial cross-sectional side view of the closure cap as it initially contacts a container finish (having an alternative finish profile) during application of the closure onto the finish.
Figure 20:
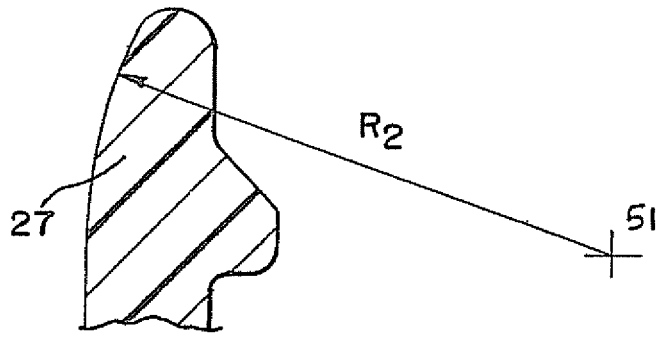
FIG. 20 is an enlarged, partial cross-sectional side view of a container finish having a generally torroidal-like profile.

It will be appreciated that the liner profile described above can be used in closures used to seal containers also having a generally semi-toroidal finish profile as shown in FIGS. 7-8 and 20, or with a container finish having a more typical straight line profile i.e., that tapers from a vertical axis of the container finish at a fixed angle as shown in FIGS. 9-10. Thus, the above-described sealing sequence occurs whether container finish 27 also has an arc-shaped or semi-toroidal profile as shown in FIGS. 7 and 8, or a profile that is defined by a specific and measurable angle relative to a vertical axis of the finish, shown in FIGS. 9 and 10.

Returning briefly to FIG. 2, closure cap 10 may include a plurality of annularly spaced vents 50 along the bottom surface 21 of flange 18. Vents 50 provide flow channels for draining liquid (water) used to cool or rinse the package. Vents 50 may be regularly spaced from each other and separated by portions of flange 18 identified by reference numeral 52. When the container is sealed by closure cap 10, portions 52 are in contact with the radially outer peripheral portion of end panel 20, as shown, for example, in FIGS. 5, 8 and 10.

Shell 12 of the closure shown in FIG. 1-10 includes top flange 18 integrally formed with skirt 14. Flange 18 includes a top surface 19, and a bottom surface 21. More specifically, as shown in FIGS. 2 and 4, both flange top surface 19 and bottom surface 21 have a generally C-shaped profile (e.g., rotated 90° or downwardly facing) where the top surface 19 and bottom surface 21 are parallel to one another. As indicated above, flange 18 may include a radially inner downwardly extending lip 18*a*. Thus, bottom surface 21 of flange 18 is defined by inner lip surface portion 21*a*, an outer portion 21*c*, and an intermediate portion 21*b*, providing flange 18 with its generally downwardly facing C-shaped profile 74 whereby flange 18 is adapted to receive the radially outer peripheral portion 46 (and wall segment 44) of end panel 20. Similarly, flange top surface 19 may be defined by radially inner downwardly extending portion 19*a*, a radially outer, downwardly extending portion 19*c*, and an intermediate portion 19*b*, likewise providing flange outer surface 19 with the generally C-shaped profile as shown variously in FIGS. 2 and 9.

In one embodiment, flange top surface 19 may have a relatively and continuously smooth surface (as shown, for example, in FIGS. 11 and 12). Flange top surface 19 may have something other than a continuously smooth surface and include, for example, annular notch 70 on the top surface 19 at intermediate surface portion 19*b*. Notch 70 provides an indication of the amount of force applied to the closure which may serve as an indication as to whether the package is completely or only partially sealed.

Figure 15:
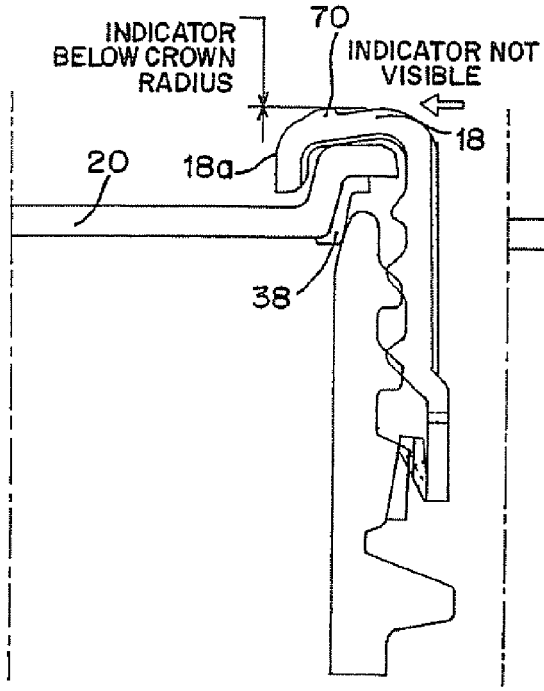
FIG. 15 is a partial, cross-sectional side view of the composite closure during initial contact of the finish and closure liner with a seal indicating notch outside the line of sight of an external sensing device.
Figure 16:
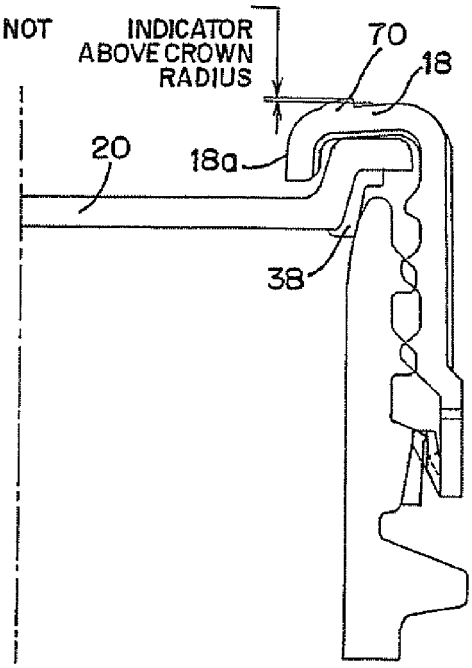
FIG. 16 is a partial, cross-sectional side view of the composite closure with the seal indicating notch slightly within the line of sight of an external sensing device.
Figure 17:
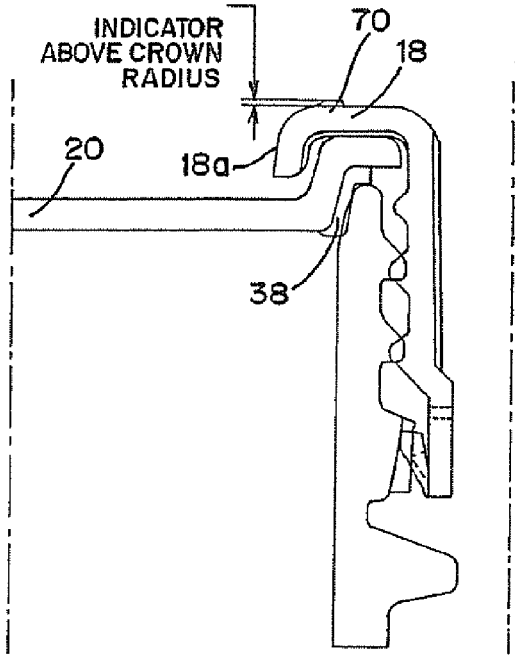
FIG. 17 is a partial, cross-sectional side view of the composite closure with the seal indicating notch more visibly within the line of sight of an external sensing device.

More specifically, as seen in FIGS. 15-18 at the initiation of the closure application sequencer, end panel 20 is loosely held within shell 12, as shown in FIG. 15. Flange 18 of shell 12 is tilted slightly such that notch 70 is not visible to an external sensing device (not shown). Stated differently, the top of notch 70 lies completely below the line of sight of the sensing device. As the amount of force applied increases and closure 10 is further applied to the container, the bottom surface of flange 19*b* comes into increasing contact with the top surface of the radially outer peripheral portion 46 of end panel 20. Flange 18 assumes a more horizontal (less tilted) orientation and in doing so notch 70 enters the line of sight of the external sensing device, as shown in FIG. 16. An example of a sensing device suitable for detecting proper sealing in the manner described above is Silgan Equipment Model 51R49 Vision System, available from Silgan Equipment Co. of Waukegan, Ill.

Figure 18:
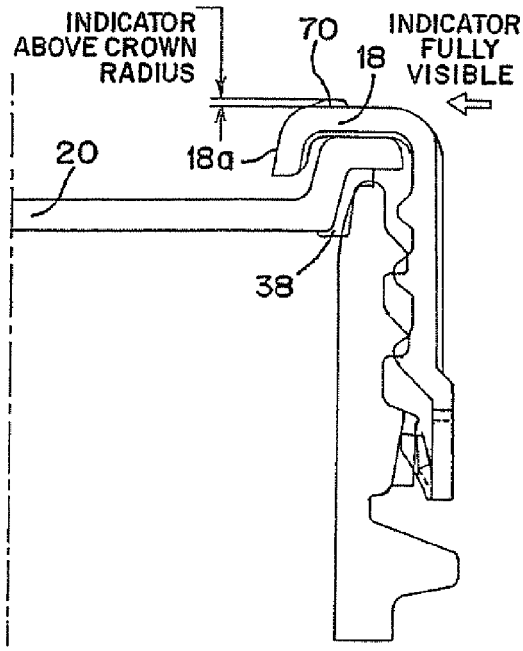
FIG. 18 is a partial, cross-sectional side view of the package of FIGS. 15-17 with the seal indicating notch fully within the line of sight of the external sensing device.

As application and sealing of the closure to the container continues, notch becomes more visible to the external sensing device until it is fully visible as shown in FIG. 18. The degree to which notch 70 is visible is an indication of the force applied to ensure an adequate seal. For example, a fully visible notch 70 indicates a sealing force sufficient to completely seal the package. Where notch 70 is less than fully visible, a lower sealing force and, thus, a less than completely sealed package may be indicated.

In the alternative embodiment of a one-piece closure 10, shown in FIGS. 11 and 12, shell 12, may also include a plurality of external vents 76. Typically, vents 76 are annularly spaced from one another along the entire circumference of shell 12. As shown in FIGS. 11 and 12, for example, vents 76 open to the outside in flange 18 between central curved portion 19*b* and downwardly extending radially outer portion 19*c* of flange top surface 19. Vents 76 provide a flow path between skirt 14 and the finish 27 of the container.

Unlike other retortable composite closures which often require both radially inner and radially outer sealing of the container finish, composite closure 10 of the present invention, as shown in FIGS. 1-20 primarily provides an inner and top seal. An effective seal is maintained to the container, even after subjecting the package to the elevated temperatures of retort.

Figure 21:
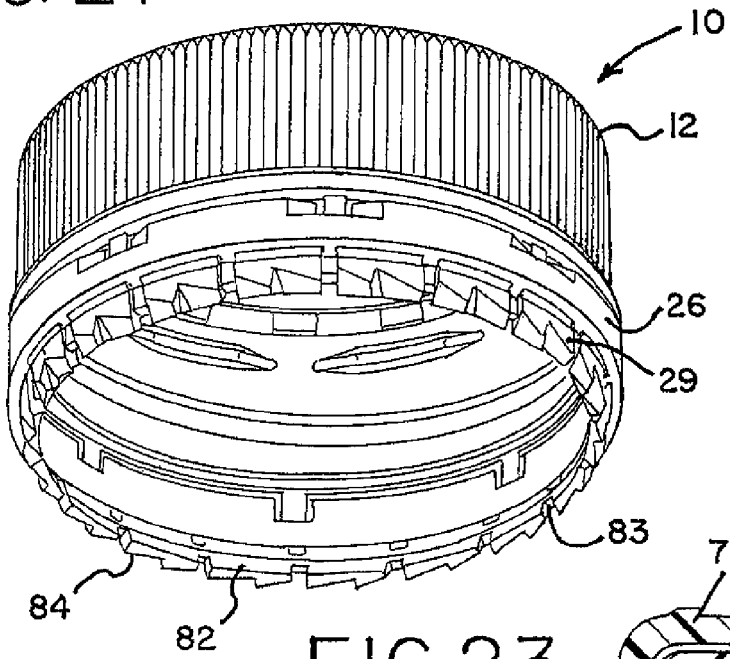
FIG. 21 is a perspective view of the closure cap embodying the present invention with the tamper evident band and the ratchet flap in the downward non-folded position.
Figure 22:
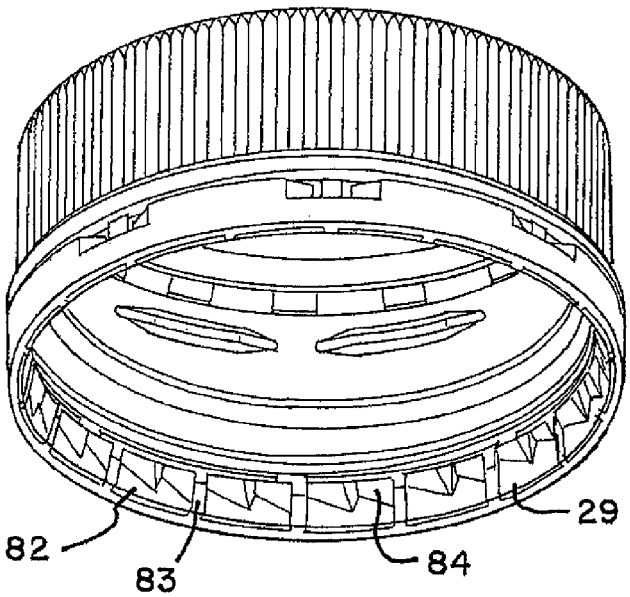
FIG. 22 is a perspective view of the closure cap of FIG. 21 with the ratchet flap in the upwardly extending folded position.

Turning now to FIGS. 21-22, there is shown a closure 10 with tamper evident band 26 suitable for use with the closure 10 of the various embodiments described above. As previously indicated, annularly extending tamper evident band 26 is attached to skirt 14 by a series of bridges 94. As indicated above, band 26 includes member 29 at the terminal end of tamper evident band 26.

Figure 23:
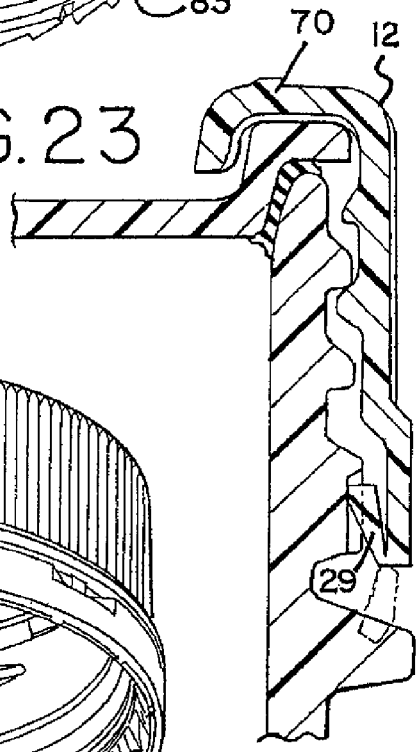
FIG. 23 is a partial cross-sectional view of the closure cap of FIGS. 21 and 22 with the ratchet flap in the upward folded position.

In one embodiment, retaining member 29, as shown in FIGS. 21-22, includes one or more annular flap(s) 82 that depend(s) from the terminal end of tamper evident band 26. Flaps 82 are foldable as shown in FIGS. 22-23 and prior to application of closure 10 onto container finish 27, flaps 82 are folded upwardly and inwardly. As indicated above, flap(s) 82 may be provided as a single continuous flap or as a plurality of individual flaps. Where retaining member 29 is made of a plurality flaps, flaps 82 may be interconnected by thin webs 83 of (plastic) material.

As shown in FIG. 22, each flap 82 includes one or more ratchets 84. Thus, prior to application of closure 10, all flaps 82 are folded inwardly and upwardly and provide an annular, at least substantially continuous and, more preferably, continuous ring of ratchets. As will be described in detail below, ratchets 84 cooperate with ratchets on the container finish. As shown in the Figures, in a preferred embodiment, each flap 82 includes preferably 2 ratchets per flap.

Figure 24:
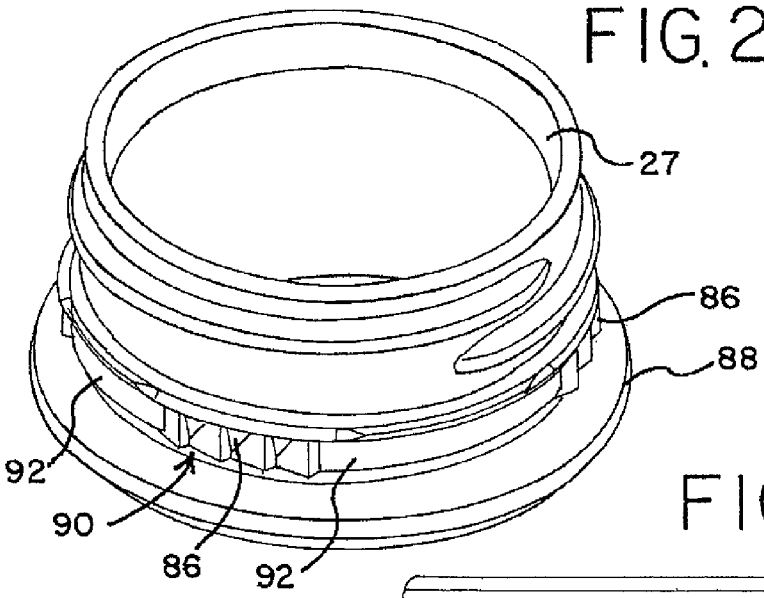
FIG. 24 is a partial perspective view of the container finish including annular ratchet groups and support beads therebetween.
Figure 25:
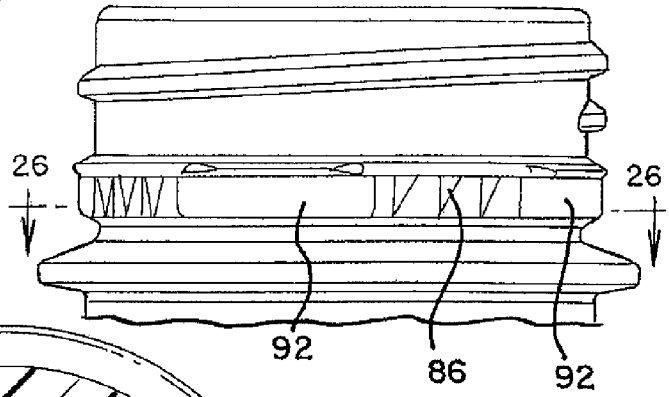
FIG. 25 is a side view of the closure container finish of FIG. 24.
Figure 26:
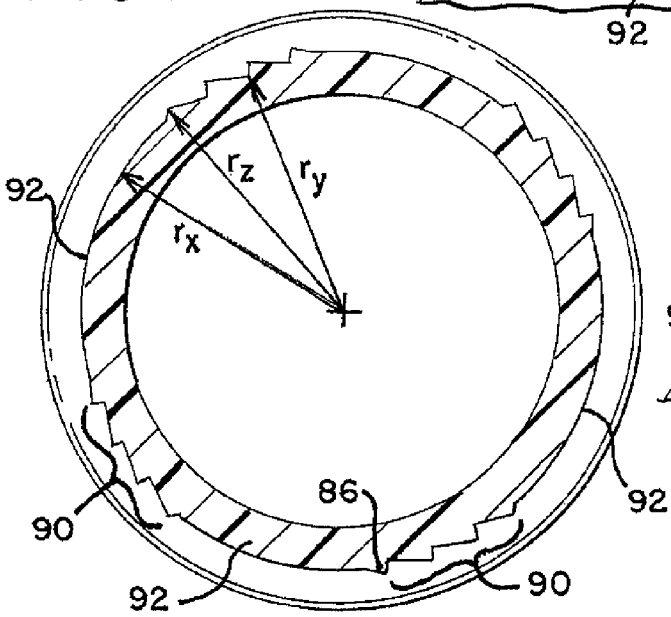
FIG. 26 is a cross-sectional top view taken along line 26-26 of the container finish of FIG. 25.

FIG. 24 shows a preferred container finish for use with closure 10 described above. As shown in FIGS. 24-26, finish 27 includes annular ratchets 86 above ring 88 of the container finish. Ratchets 86 are typically not continuous around the diameter of the container finish 27 but are instead provided in separate ratchet groups 90.

Ratchet groups 90 are annularly spaced from each other around the circumference of finish 27. The number of ratchet groups and ratchets per ratchet group may be any number desired or required. In the embodiment shown in FIGS. 24-26, there are shown 4 ratchet groups, each ratchet segment includes 4 ratchets. Of course, any number of ratchets per group that provides for adequate engagement and proper performance without negatively affecting the molding process may be used. As shown in FIG. 26, ratchet groups 90 are symmetrically disposed around the container finish 27, and span approximately 120° of the container neck circumference, with each segment being approximately 30° in length. Ratchets on the ratchet groups may be identical or as shown in the Figures, more likely have slightly different geometries for reasons related to the molding of the ratchets, as will be appreciated by those of skill in the art.

Figure 27:
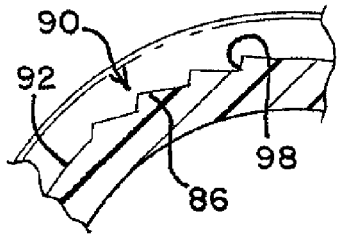
FIG. 27 is a partial cross-sectional view of a ratchet segment of FIG. 26.

Ratchet groups 90 cooperate with the ratchets on the closure 10. In a preferred embodiment, areas between ratchet groups 90 are occupied by a plurality of support beads 92 each having an outer coaxial arcuate surface increased diameter, relative to the diameter of the root of ratchets in the groups 90. Preferably, the outer diameter of the support bead is such that when closure 10 is fully applied to the finish, the tips of at least some and preferably all of the closure ratchets 86, that are opposite support bead 92 are in contact with the outer surface of support bead 92. In one embodiment, the outer diameter ($r_x$) of the support bead 92 between ratchet groups is greater than the diameter of the ratchet root, ($r_y$) but less than the diameter of the ratchet tip ($r_z$). As used herein, the "ratchet root" refers to the radially inner point between adjacent ratchets identified by reference numeral 98 in FIG. 27.

Figure 28:
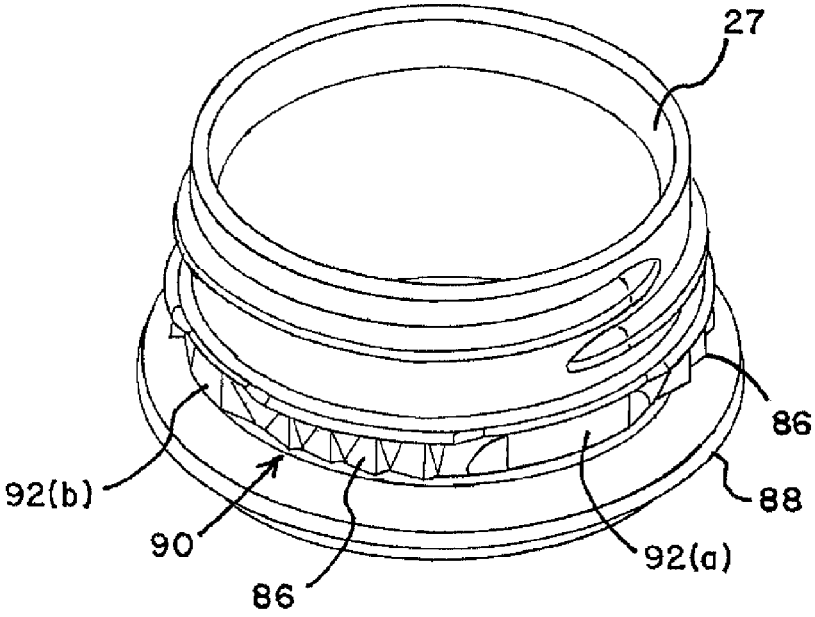
FIG. 28 is a perspective view of an alternative embodiment of the container finish with annular ratchet groups and support beads therebetween.
Figure 29:
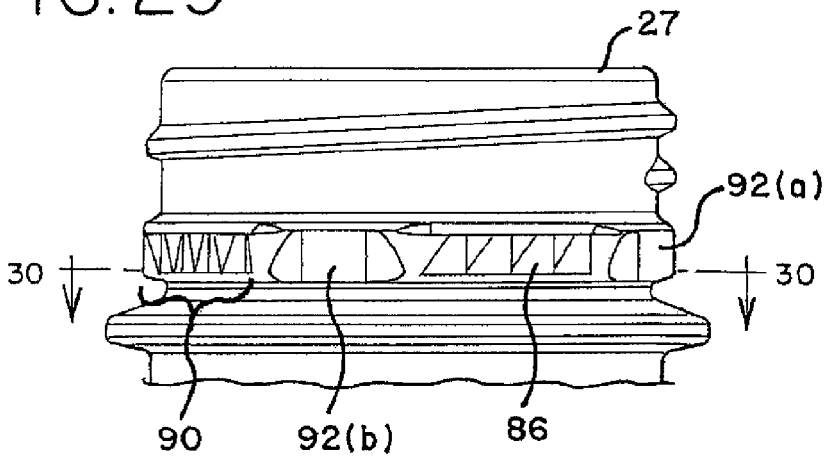
FIG. 29 is a side view of the container finish of FIG. 28.
Figure 30:
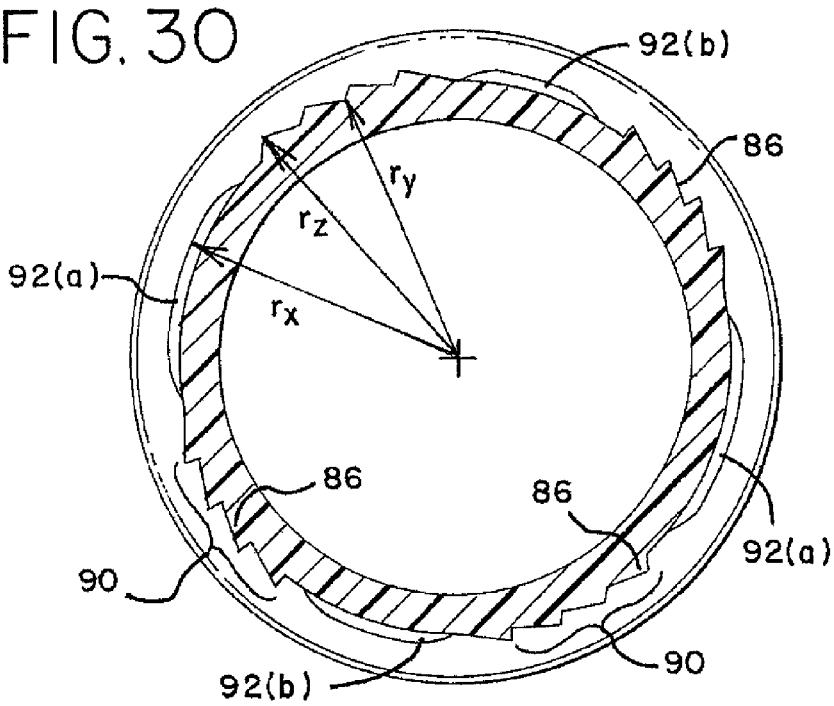
FIG. 30 is a cross-sectional top view taken along line 30-30 of the container finish shown in FIG. 29.

Preferably, support bead(s) 92 span the entire distance between ratchet groups 90 and has a uniform (increased) diameter between ratchet groups 90. In an alternative embodiment, shown in FIGS. 28-30, the diameter of support beads 92(*a*) and 92(*b*) are substantially uniform with the exception of the ends of support bead 92(*a*) and 92(*b*) adjacent to ratchet groups 90, where beads 92(*a*) and 92(*b*) taper inwardly as it approaches ratchet groups 90. In one embodiment of FIG. 26, support beads 92 span approximately 240° of the container neck circumference, with each bead 92 between ratchet groups 90 having a distance of approximately 60°. As shown in FIG. 30, support beads 92(*a*) and 92(*b*) span less than 240°. In addition, support beads 92(*a*) and 92(*b*) may have different lengths.

Figure 31:
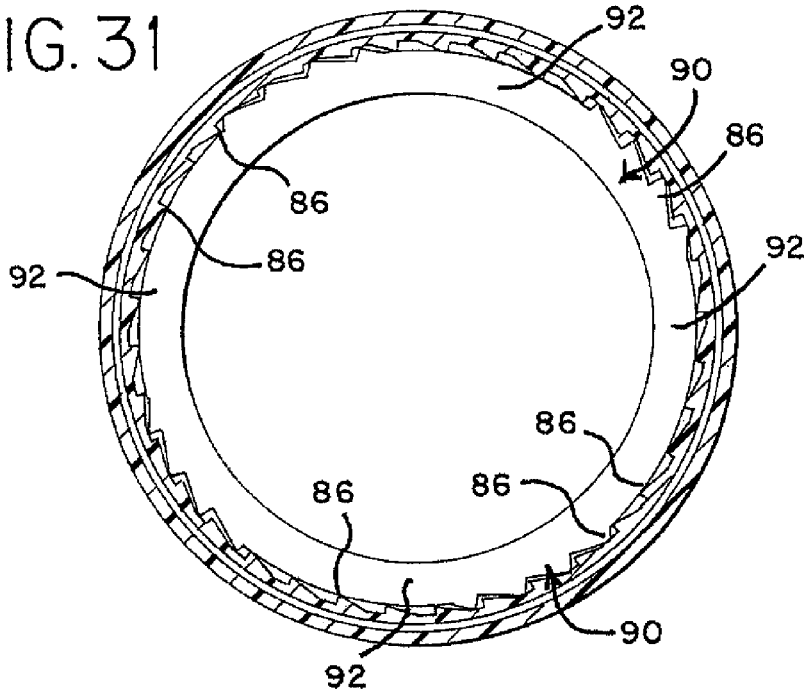
FIG. 31 is a cross-sectional top view of the container finish of FIGS. 24-26 with the closure cap placed thereon.

Support beads prevent deformation and inward deflection of band 26. Deformation and/or inward deflection of the tamper band is undesirable as it may allow the closure to be removed without proper bridge fracture, thereby defeating the purpose of the tamper evident band. The support beads function to prevent such inward deflection during closure cap removal and also provide assurance against tampering. Providing support beads also results in greater engagement of the ratchets on the closure 10 with the ratchets on container finish 27. As shown in FIG. 31, and described above, when closure 10 is fully applied to the container finish, the tips of closure ratchets 86 opposite contact the support beads thereby preventing deformation (i.e., ovalization of the band) and inward deflection toward bead 92, 92(*a*) and/or 92(*b*).

As described above, band 26 is attached to skirt 12 by a plurality of annular bridges 94(*a*) and 94(*b*). As shown in FIG. 32, bridges 94 may be symmetrically spaced around the circumference of closure 10. As further shown in FIG. 32, band 26 includes windows 96 where bridges 94(*a*) and 94(*b*) connect band to skirt 12. In one embodiment, all of the bridges may be identical in size, shape and overall geometry. In a preferred embodiment, however, the individual bridges 94 may have two or more different structural designs. For example, as shown in FIG. 32, closure 10 is provided with a plurality of bridges with at least 2 different configurations (94*a* and 94*b*), each configuration having a different geometry, length, thickness and/or orientation. It is believed that use of non-uniform bridges will facilitate sequential bridge breakage during the opening sequence.

In the embodiment illustrated in FIG. 32, bridges 94(*a*) and 94(*b*) are located symmetrically around the circumference of the tamper band. If desired, however, non-symmetrical spacing of the bridges can be utilized to further modify the forces required to rupture the bridges at various locations along the circumference of the tamper band. As further seen in FIG. 32, each group of bridges includes at least two adjacent bridges of the same type. Because of differences in either their shape, vertical length, thickness or a combination thereof, bridges 94(*a*) are first to fracture during the opening sequence. The bridges 94(*b*) fracture next. In this particular embodiment, the greater vertical length and elongated shape and orientation of bridges 94(*b*) allow the bridges 94(*b*) to flex through an angle of closure opening without fracture while the other bridges 94(*a*) are fractured. Following the fracture of bridges 94(*a*), bridges 94(*b*) fracture, thus reducing the required opening torque.

While the present invention has been described in connection with various embodiments, it will be apparent to those skilled in this art that modifications and variations may be made therefrom without departing from the spirit and scope of this invention. Accordingly, this invention is to be construed and limited only by the scope of the appended claims.

That which is claimed:

1. A composite closure cap for a container comprising: a plastic shell including a generally inwardly extending annular top flange and a radially outer, downwardly depending skirt extending from said flange, said inwardly extending flange defining a central opening in said shell;

an end panel held within said shell, said end panel including a top surface and a bottom surface, said end panel comprising (a) a central portion covering said central opening, (b) a generally upwardly extending portion extending from said central portion and (c) terminating in a radially, outer peripheral portion, said generally upwardly extending portion having a lower end adjacent to said central portion and an upper end adjacent to said radially outer peripheral portion, wherein the bottom surface of said end panel of said generally upwardly extending portion and of said radially outer peripheral portion provides a liner receiving surface;

wherein said bottom surface of said outer peripheral portion is substantially perpendicular to said skirt;

a liner molded onto said liner receiving surface, said liner having a finish contacting outer surface, wherein said finish contacting outer surface has a generally toroidal-like surface profile prior to contact with a container finish, wherein said liner has a thickness that is increased where said liner is in contact with said lower end of said generally upwardly extending portion of said end panel relative to where said liner is in contact with said upwardly extending portion between said upper and lower ends thereof.

2. The composite closure cap of claim 1 wherein said liner has a thickness that is greatest where said liner is in contact with said lower end of said generally upwardly extending portion of said panel.

3. The composite closure of claim 1 wherein said end panel includes a material that has oxygen barrier properties.

4. The composite closure of claim 1 wherein said panel includes a film having oxygen barrier properties.

5. The composite closure of claim 4 wherein said film comprises multiple layers wherein at least one of said layers includes a material having oxygen barrier properties.

6. The composite closure of claim 4 wherein said film further includes an oxygen scavenger.

7. The composite closure of claim 1 wherein said shell includes a seal indicator associated with said flange.

8. The composite closure of claim 7 wherein said seal indicator comprises an upstanding notch on the top surface of said flange.

9. The composite closure of claim 1 wherein said generally upwardly extending portion includes a radially outer surface that extends outwardly approximately 10°-20° from a vertical axis of said panel.

10. A closure cap for a container comprising: a plastic shell including a generally inwardly extending annular top flange and a radially outer, downwardly depending skirt extending from said flange, said inwardly extending flange defining a central opening in said shell;

an at least substantially plastic end panel held within said shell, said end panel including a top surface and a bottom surface, said end panel comprising a central portion, a radially outer peripheral portion and a downwardly depending plug between the central and peripheral portion, the plug including a radially outer surface;

a liner applied primarily to at least a portion of said radially outer surface of said plug and at least a portion of said radially outer peripheral portion, said liner having a finish contacting outer surface, wherein said finish contacting outer surface has a generally toroidal-like surface profile prior to contact with a container finish, and wherein a portion of said liner applied at the juncture of the plug with the radially outer peripheral portion of said end panel has an increased thickness relative to a portion of said liner applied to the plug at a location spaced from said juncture.

11. The closure of claim 10 wherein said end panel includes a material that has oxygen barrier properties.

12. The closure of claim 11 wherein said panel includes a film having oxygen barrier properties.

13. The closure of claim 12 wherein said film comprises multiple layers wherein at least one of said layers includes a material having oxygen barrier properties.

14. The closure of claim 12 wherein said film further includes an oxygen scavenger.

15. A closure cap for a container comprising: a plastic shell including a generally inwardly extending annular top flange and a radially outer, downwardly depending skirt extending from said flange, said inwardly extending flange defining a central opening in said shell;

an at least substantially plastic end panel held within said shell, said end panel including a top surface and a bottom surface, said end panel comprising a central portion, a radially outer peripheral portion and a downwardly depending plug between the central and peripheral portion, the plug including a radially outer surface;

a liner applied to said radially outer surface of said plug, said liner having a finish contacting outer surface, wherein said finish contacting outer surface has a generally toroidal-like surface profile prior to contact with a container finish, and wherein a portion of said liner applied at the juncture of the plug with the radially outer peripheral portion of said end panel has an increased thickness relative to a portion of said liner applied to the plug at a location spaced from said juncture;

wherein said plug outer surface has an angle relative to a vertical axis of approximately 10°-20°.

16. A package comprising: a container including a container finish, said finish including an inner sealing surface and a top sealing surface and an outer surface, a closure cap comprising a plastic shell and an end panel, said end panel having a top surface and a bottom surface, said bottom surface comprising a portion having a liner applied thereon;

wherein said inner sealing surface of said container finish comprises a generally toroidal-like surface;

said liner including an outer, finish-contacting surface that has a generally toroidal-like surface profile prior to contact with said container finish and including a portion of increased thickness relative to the remainder of said liner; and a seal formed between said closure and said container, primarily at said inner and top sealing surfaces of said container.

17. The package of claim 16 wherein said portion having a liner applied thereon comprises a lower end and upper end and an intermediate portion therebetween, said liner having a thickness that is greater at said lower end than said intermediate portion.

18. The package of claim 17 wherein during application, container finish initially contacts said liner at said lower end.

19. A package comprising: a container including a container finish, said finish including an inner sealing surface and a top sealing surface and an outer surface, a closure cap comprising a plastic shell and an end panel, said end panel having a top surface and a bottom surface, said bottom surface comprising a portion having a liner applied thereon;

said end panel comprising a central portion and a radially outer peripheral portion and an intermediate portion extending generally upwardly from said central portion;

said liner including an outer, finish contacting surface that has a generally toroidal-like surface profile prior to contact with said container finish and including a portion of increased thickness where said liner is in contact with a lower end of said generally upwardly extending portion relative to the remainder of said liner; and a seal formed between said closure and said container, primarily at said inner and top sealing surfaces of said container.

20. The package of claim 19 wherein said intermediate portion is offset from a vertical axis by approximately 10°-20°.

21. The package of claim 20 wherein said closure comprises a composite closure including a shell and a substantially plastic end panel held within said shell.

22. A package comprising: a container including a container finish, said finish including an inner sealing surface and a top sealing surface and an outer surface, a closure cap comprising a plastic shell and an end panel, said end panel having a central portion and a radially outer peripheral portion, a top surface and a bottom surface, said bottom surface comprising a portion having a liner applied thereon;

said end panel comprising a plug depending downwardly from said bottom surface of said end panel relative to said central and outer peripheral portions;

said liner including an outer, finish contacting surface that has a generally toroidal-like surface profile including a portion of increased thickness relative to the remainder of said liner prior to contact with said container finish; and a seal formed between said closure and said container, primarily at said inner and top sealing surfaces of said container.

* * * * *